US008636536B2

(12) United States Patent
Suemitsu et al.

(10) Patent No.: US 8,636,536 B2
(45) Date of Patent: Jan. 28, 2014

(54) ELECTRICAL CONNECTOR MEMBER

(75) Inventors: Yoshifumi Suemitsu, Chiba (JP); Ryuichi Komiyama, Tokyo (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 34 days.

(21) Appl. No.: 13/331,233

(22) Filed: Dec. 20, 2011

(65) Prior Publication Data

US 2012/0164866 A1 Jun. 28, 2012

(30) Foreign Application Priority Data

Dec. 28, 2010 (JP) ..... 2010-291864

(51) Int. Cl.
*H01R 13/625* (2006.01)

(52) U.S. Cl.
USPC ..... 439/345; 439/752

(58) Field of Classification Search
USPC ..... 439/345, 357, 595, 660, 701, 752
See application file for complete search history.

(56) References Cited

U.S. PATENT DOCUMENTS 4,200,350 A * 4/1980 Zimmerman, Jr. ..... 439/357
5,059,142 A * 10/1991 Ohta et al. ..... 439/752
5,160,283 A * 11/1992 Fry et al. ..... 439/752
5,439,397 A * 8/1995 Yamanashi et al. ..... 439/752
5,769,670 A * 6/1998 Abe ..... 439/752
6,106,340 A * 8/2000 Myer et al. ..... 439/752
6,482,035 B2 * 11/2002 Okabe et al. ..... 439/596
6,971,924 B2 * 12/2005 Fujita ..... 439/752
2002/0002002 A1 1/2002 Okabe et al.
2008/0119084 A1 5/2008 Hitchcock et al.

FOREIGN PATENT DOCUMENTS

JP 11-8004 A 1/1999
JP 2001-332333 A 11/2001

OTHER PUBLICATIONS

European Search Report, dated Nov. 11, 2013, 6 pages.

* cited by examiner

*Primary Examiner* — Thanh Tam Le
(74) *Attorney, Agent, or Firm* — Barley Snyder

(57) ABSTRACT

A connector member that is improved in durability and reliability by preventing fracture of hinges of a retainer and can be smoothly mated with a mating connector. The connector member having a lance housing. a connector housing, and the retainer. The lance housing includes a plurality of terminal receiving slots, a recess disposed at a rear of the plurality of terminal receiving slots and in a portion of the lance housing near a rear surface thereof, and a pair of guide walls positioned opposite each other along a top surface of the lance housing. The connector housing includes a housing recess opening at one side for housing the lance housing. The retainer is fitted into the recess of the lance housing and swingably connected to the lance housing by a hinge.

10 Claims, 10 Drawing Sheets

ELECTRICAL CONNECTOR MEMBER

CROSS-REFERENCE TO RELATED APPLICATIONS

This application claims the benefit of the filing date under 35 U.S.C. §119(a)-(d) of Tyco Electronics Japan G.K. Patent Application No. 2010-291864, filed Dec. 28, 2010.

FIELD OF THE INVENTION

The present invention relates to a connector member and in particular to a connector member used to connect an electrical wire to a wiring board.

BACKGROUND

Male connectors and female connectors are generally used to electrically connect electrical wires to circuit boards of various types of electrical devices in an automobile, for example, when mated together.

Typically, a male connector and a female connector both have a housing made of an insulating material such as a resin and a plurality of terminals made of a conductive material such as a metal housed in the housing, wherein each terminal is connected to one end of a wire.

In recent years, a demand is growing for downsizing these connectors used to electrically connect an electrical wire to a circuit board for an automobile, for example.

To prevent the terminals from dropping off the housing, the housing of a connector is provided with a lance (a protrusion). As the connector is downsized, the internal structure becomes denser. As a result, the terminals and therefore the lance are also downsized. The smaller the lance, the less firmly the lance holds the terminals, such that the ability to prevent the terminals from dropping off deteriorates.

In view of such circumstances, the housing may be provided with a retainer, which prevents the terminals from dropping off the housing (see Japanese Patent Laid-Open No. 11-8004 and Japanese Patent Laid-Open No. 2001-332333, for example).

As shown in FIG. 10, a housing 1 includes slots 2 formed at intervals for holding a plurality of terminals. A terminal connected to one end of an electrical wire is inserted into and secured in each slot 2.

The housing 1 has an opening 3 formed in a part of one side that faces the terminals inserted into the slots 2. A retainer 4 closes the opening 3, and secures the terminals in the opening 3.

In the embodiment shown, the retainer 4 is attached to the housing 1 by hinges 5. The retainer 4 opens and closes the opening 3 by pivoting on the hinges 5 between a position where the retainer 4 is spaced apart from the opening 3 and positioned where the retainer 4 closes the opening 3.

However, when the housing 1 with the retainer 4 is fitted to the housing of the mating connector, the hinges 5 of the retainer 4 may collide with the housing of the mating connector and be fractured.

Furthermore, the connectors may not be smoothly mated with each other because of the interference between the hinges 5 and the housing of the mating connector.

SUMMARY

The present invention has been devised in view of such technical problems, and an object of the present invention, inter alia, is to provide a connector member that is improved in durability and reliability by preventing fracture of hinges of a retainer and can be smoothly mated with a mating connector.

A connector member that is improved in durability and reliability by preventing fracture of hinges of a retainer and can be smoothly mated with a mating connector. The connector member having a lance housing. a connector housing, and the retainer. The lance housing includes a plurality of terminal receiving slots, a recess disposed at a rear of the plurality of terminal receiving slots and in a portion of the lance housing near a rear surface thereof, and a pair of guide walls positioned opposite each other along a top surface of the lance housing. The connector housing includes a housing recess opening at one side for housing the lance housing. The retainer is fitted into the recess of the lance housing and swingably connected to the lance housing by a hinge.

DETAILED DESCRIPTION OF THE EMBODIMENT(S)

In the following, the present invention will be described in detail with regard to an embodiment shown in the accompanying drawings.

Figure 1A:
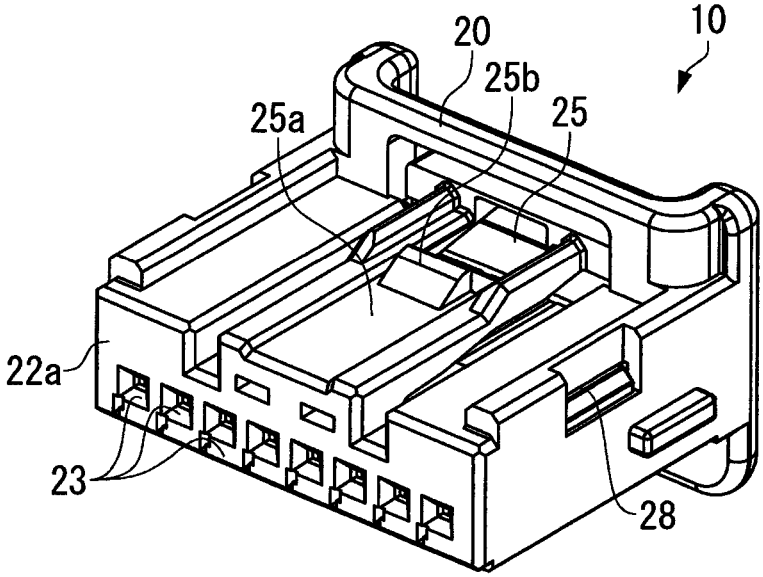
FIG. 1A is a perspective view of a female connector according to invention, when viewed from a side having a locking member
Figure 1B:
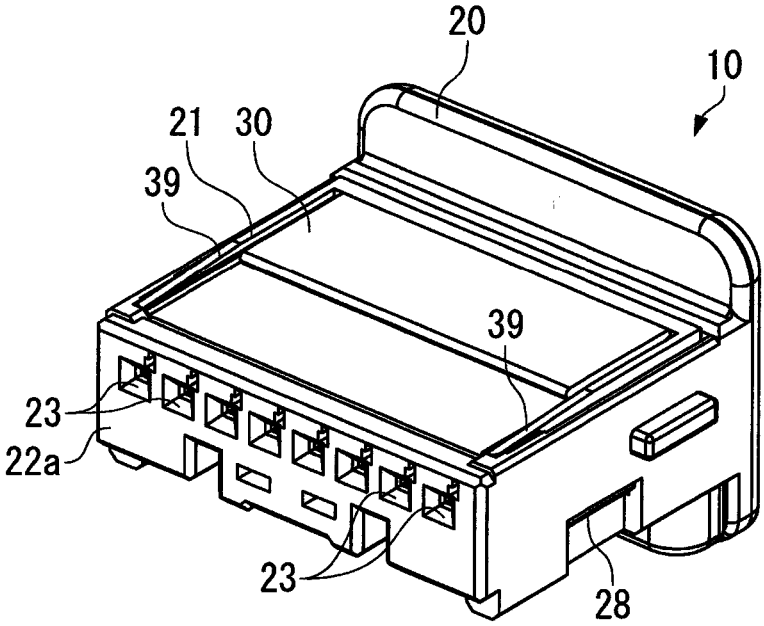
FIG. 1B is a perspective view of the female connector according to the invention, when viewed from another side having a lance housing.

As shown in FIGS. 1A and 1B, a female connector 10 according the invention includes a connector housing 20 and a lance housing 30.

Figure 2A:
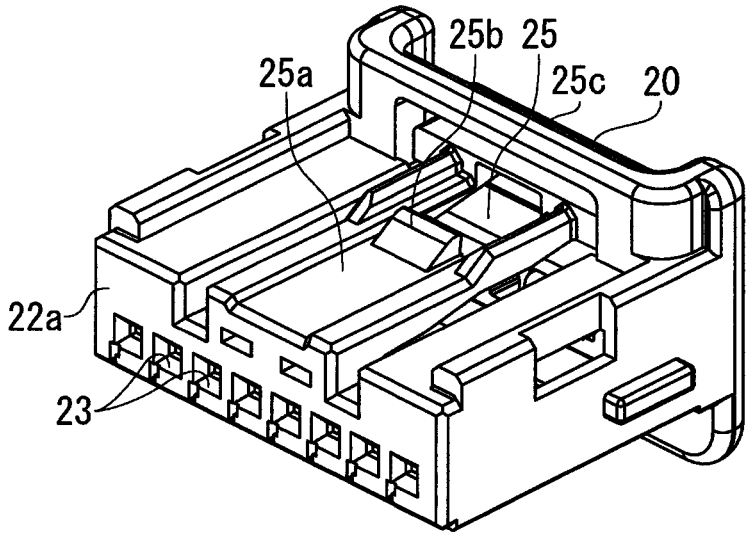
FIG. 2A is a perspective view of a connector housing of the female connector shown in FIGS. 1A and 1B, in which body viewed from the side of the locking member.
Figure 2B:
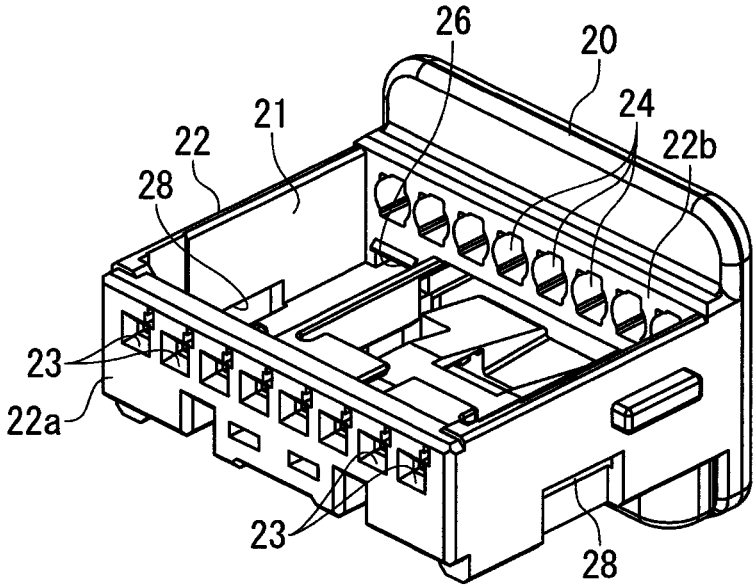
FIG. 2B is a perspective view of the connector housing, when viewed from the side having the lance housing.
Figure 3:
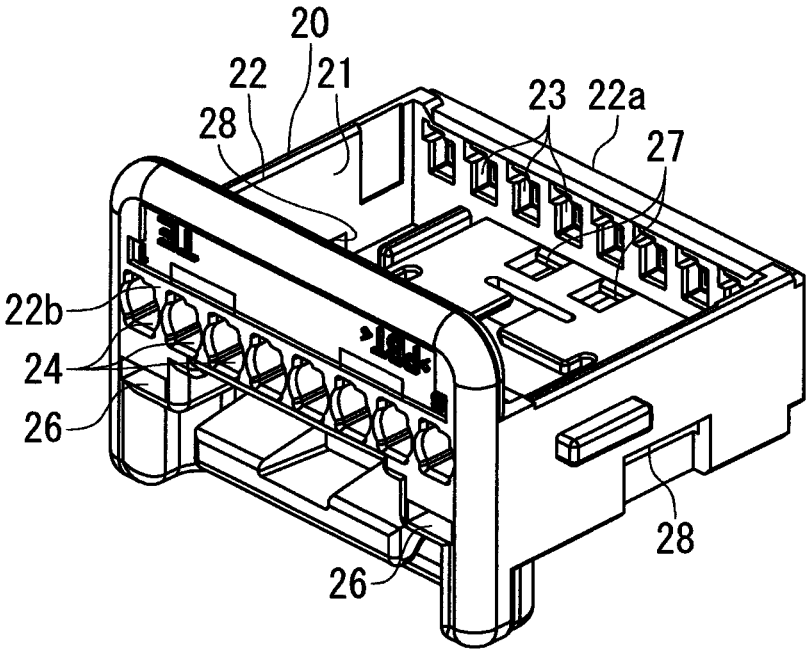
FIG. 3 is a perspective view of the connector housing shown in FIGS. 2A and 2B when viewed from the side thereof at which the lance housing is housed.

As shown in FIGS. 2 and 3, the connector housing 20 has a housing recess 21 opening at one side for housing the block-shaped lance housing 30.

Of four walls 22 defining the housing recess 21 of the connector housing 20, a front wall 22*a* facing a male connector 50 described in detail later has terminal insertion holes 23 formed therein into which male terminals of the male connector 50 are inserted, and a rear wall 22*b* opposite to the front wall 22*a* has lead wire holes 24 formed therein for leading wires connected at one end to female terminals (terminals) 31 held in the lance housing 30 to the outside.

As shown in FIG. 2A, the connector housing 20 is provided with a locking member 25 to be engaged with the male connector 50. The locking member 25 has a cantilever beam 25*a* that is fixed at one end facing to the male connector 50 and is free at an opposite end, an engaging protrusion 25*b* disposed on a surface of the cantilever beam 25*a*, and an operating part 25*c* formed at the free end of the cantilever beam 25*a*.

As shown in FIGS. 2A, 2B and 3, a plurality of engaging recesses 26, 27 and 28 to be engaged with the lance housing 30 are formed in the housing recess 21.

Figure 4A:
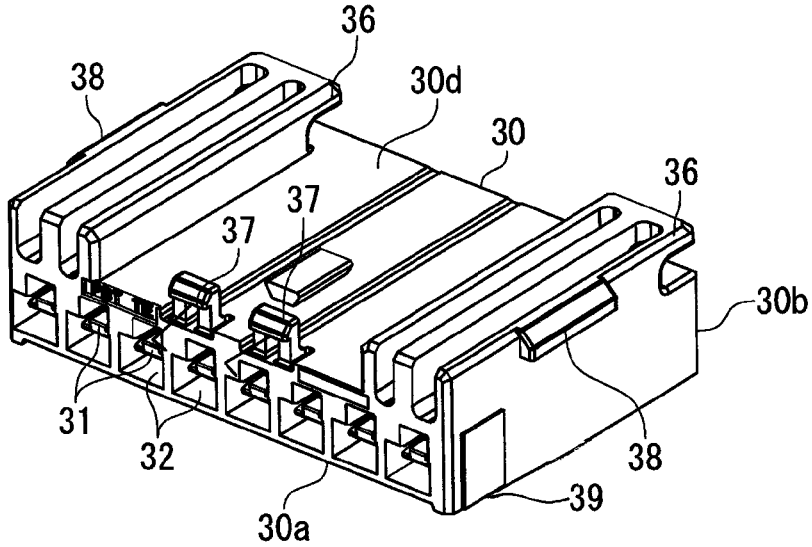
FIG. 4A is a perspective view of the lance housing viewed from the side that faces a bottom surface of a housing recess of the connector housing.
Figure 4B:
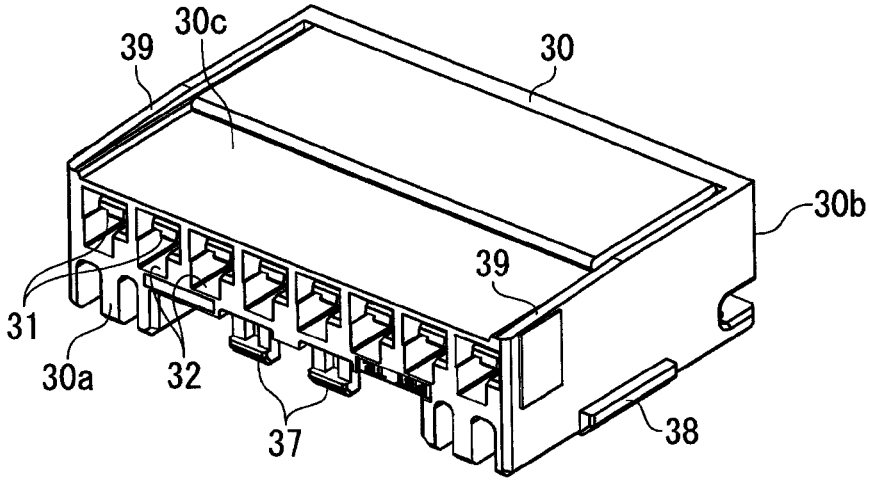
FIG. 4B is a perspective view of the lance housing viewed from the side at which the lance housing is exposed to an outside of the connector housing.

As shown in FIGS. 4A, 4B and 5, the lance housing 30 has a plurality of terminal receiving slots 32 for holding the plurality of female terminals 31. The slots 32 open at one end along a front surface 30*a* of the lance housing 30 that faces the male connector 50 and extend toward a rear surface 30*b* opposite to the front surface 30*a*. The slots 32 are arranged in the lance housing 30 at intervals in a direction parallel to a top surface 30*c* and perpendicular to the front surface 30*a*.

The female terminal 31 is inserted into and held in each slot 32. The lance housing 30 includes a recess 33 opening in the top surface 30*c* formed in a portion close to the rear surface 30*b*. The recess 33 is formed at the rear of the slots 32, and the rear portions of the female terminals 31, held in the slots 32 by their tip end parts, are positioned in the recess 33.

A wire receiving insertion passageways 34 in communication with the interior of the recess 33 are formed in the rear surface 30*b* of the lance housing 30. Through the wire receiving insertion passageways 34, one end of an electrical wire is inserted into the recess 33 from the rear of the lance housing 30 and connected to the female terminal 31 in the recess 33.

A retainer 40 for closing the opening of the recess 33 is attached to the top surface 30*c* of the lance housing 30 by a hinge 41.

The retainer 40 includes a rectangular plate part 42 swingably provided about the hinge 41, and a protrusion 43 integral with the plate part 42 formed on the side thereof facing the recess 33.

The hinge 41 is positioned along one side of the plate part 42 closer to the rear surface 30*b* of the lance housing 30. Consequently, a tip end part 40*a* of the retainer 40 closer to the front surface 30*a* of the lance housing 30 can swing about the hinge 41 between a position where the tip end part 40*a* closes the recess 33 and a position where the tip end part 40*a* is spaced apart from the recess 33 (the top surface 30*c* of the lance housing 30), thereby opening and closing the recess 33.

When the protrusion 43 of the retainer 40 is pressed into the recess 33 of the lance housing 30 to close the recess 33, the protrusion 43 abuts against a stepped part of the female terminal 31 in the recess 33. As a result, even if the electrical wire is pulled, for example, the female terminal 31 is prevented from being pulled out of the lance housing 30.

As shown in FIGS. 4A, 6A, 6B and 6C, the lance housing 30 has, on a bottom surface 30*d* thereof, a plurality of locking protrusions 36, 37 and 38 to be engaged with the engaging recesses 26, 27 and 28 formed in the housing recess 21 of the connector housing 20. The lance housing 30 is inserted into the housing recess 21 of the connector housing 20 from the bottom surface 30*d* thereof, the locking protrusions 36, 37 and 38 are engaged with the engaging recesses 26, 27 and 28, and the lance housing 30 is thereby mounted and integrated into the connector housing 20.

On the opposite sides of the retainer 40, guide walls 39 are formed on the lance housing 30 in portions close to the top surface 30*c*. The height of the guide walls 39 in the direction perpendicular to the top surface 30*c* gradually increases from the front surface 30*a* toward the rear surface 30*b* of the lance housing 30. In the vicinity of the tip end part 40*a* of the retainer 40, the height of the guide walls 39 is equal to or greater than that of the tip end part 40*a*.

Figure 7:
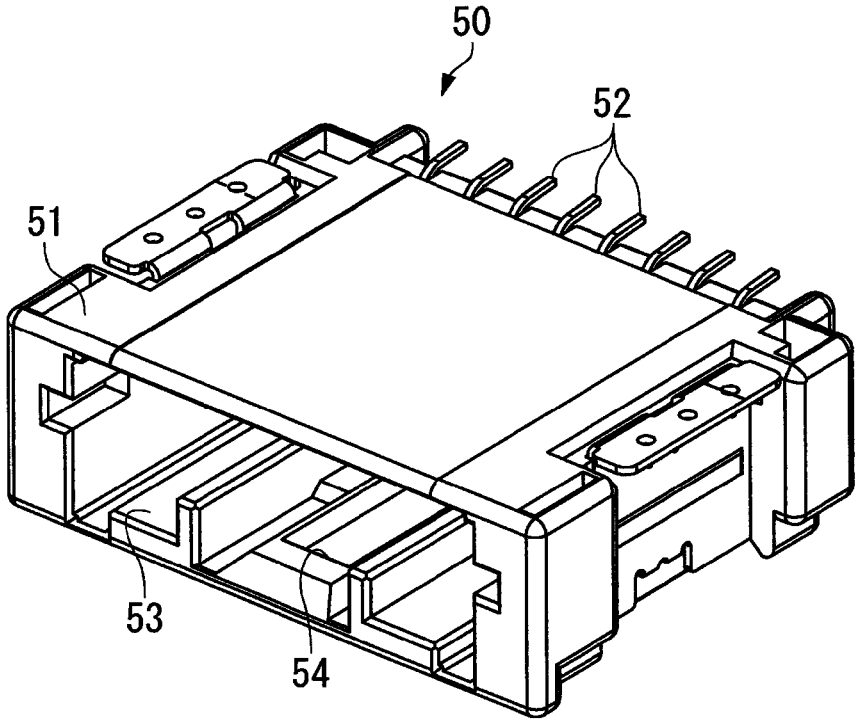
FIG. 7 is a perspective view of the male connector.
Figure 8:
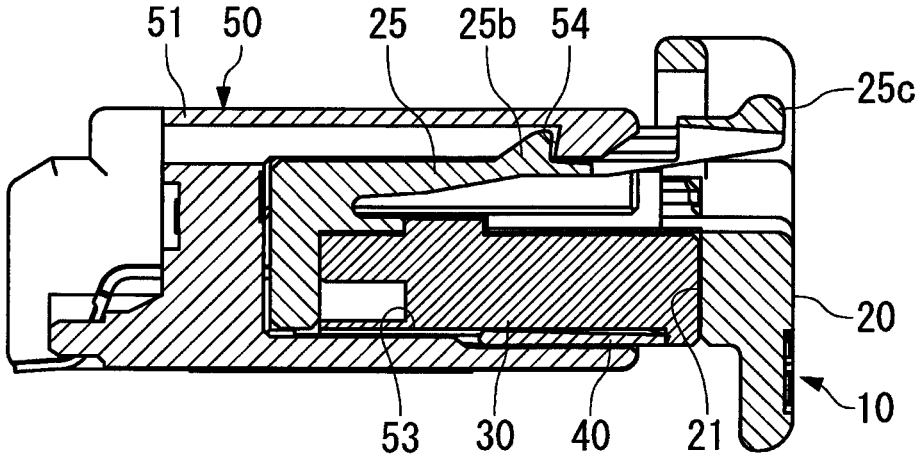
FIG. 8 is a cross-sectional view of the female connector and the male connector mated with each other.
Figure 9:
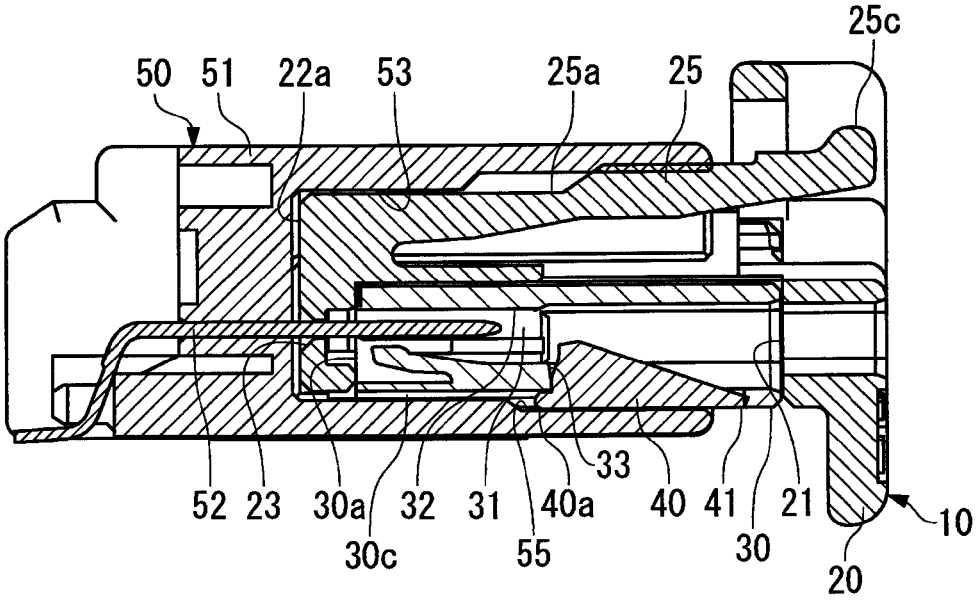
FIG. 9 is another cross-sectional view of the female connector and the male connector mated with each other.
Figure 10:
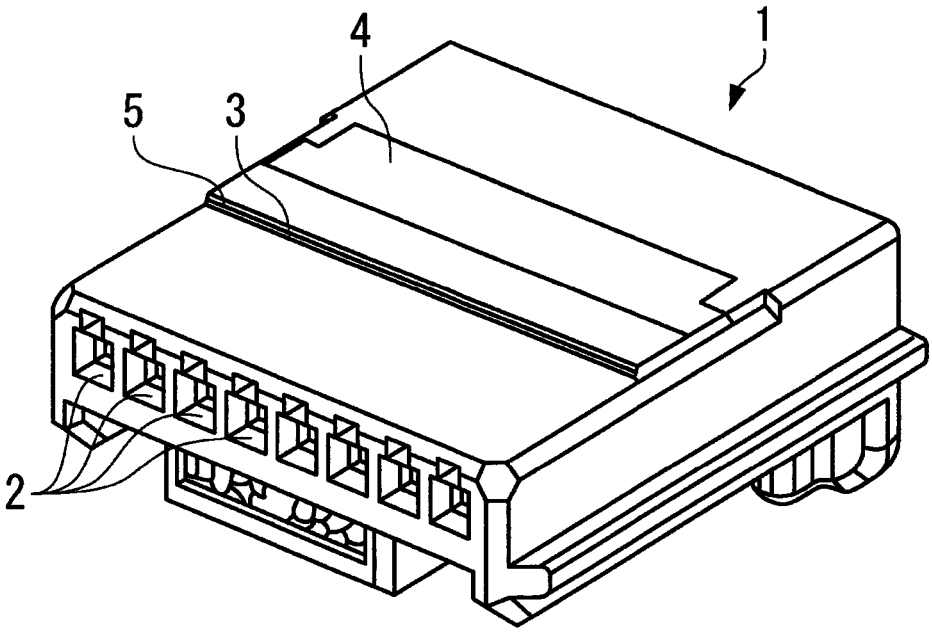
Prior Art FIG. 10
FIG. 10 is a perspective view of a known female connector.

As shown in FIG. 7, the male connector 50 includes a housing 51 and male terminals 52 held in the housing 51.

The housing 51 has a fitting recess 53 for receiving the connector housing 20 and the lance housing 30 of the female connector 10. On the inner peripheral surface of the fitting recess 53, a latch 54 to be engaged with the engaging protrusion 25*b* of the locking member 25 of the connector housing 20 is formed. When the female connector 10 is inserted into the fitting recess 53 of the male connector 50, the locking member 25 is elastically deformed so that the engaging protrusion 25*b* climbs over the latch 54. After that, the elastically deformed locking member 25 restores the original shape, so that the engaging protrusion 25*b* is engaged with the latch 54. The female connector 10 and the male connector 50 are mated with each other in this way.

The engaging protrusion 25*b* and the latch 54 can be disengaged from each other by pressing the operating part 25*c* formed at the free end of the locking member 25. Then, the female connector 10 can be removed from the fitting recess 53.

Figure 5A:
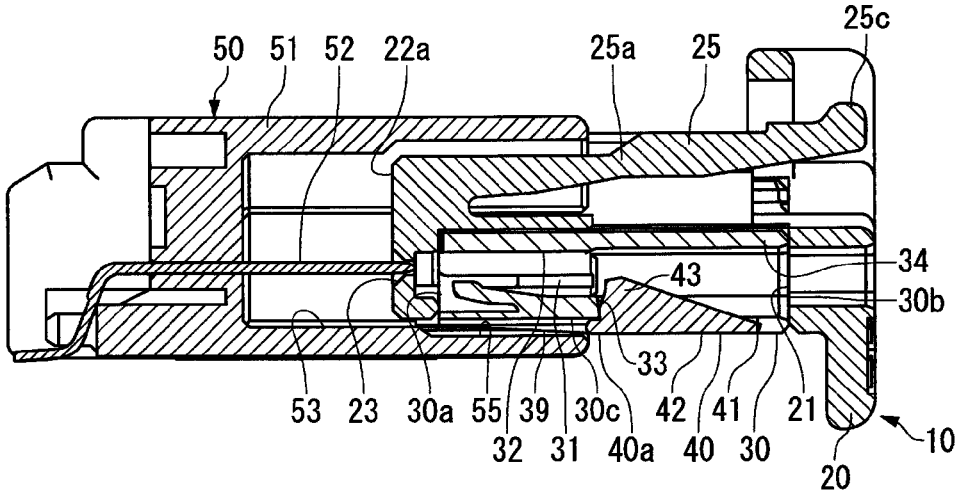
FIG. 5A is a cross-sectional view of the female connector yet to be mated with a male connector.
Figure 5B:
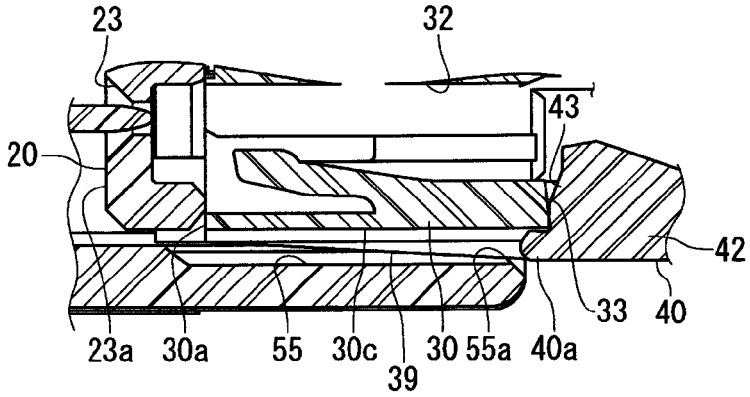
FIG. 5B is an enlarged view of essential parts the female connector yet to be mated with a male connector.
Figure 6A:
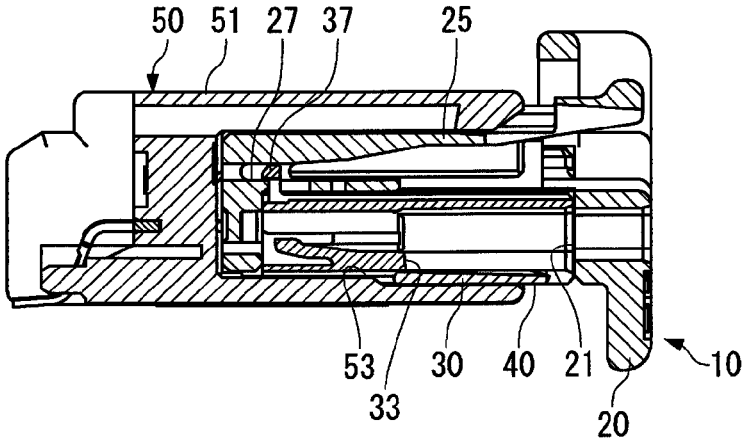
FIG. 6A is a cross-sectional view of an engagement mechanism of the lance housing and the connector housing according to the invention showing a locking protrusion provided at a front part of the lance housing.
Figure 6B:
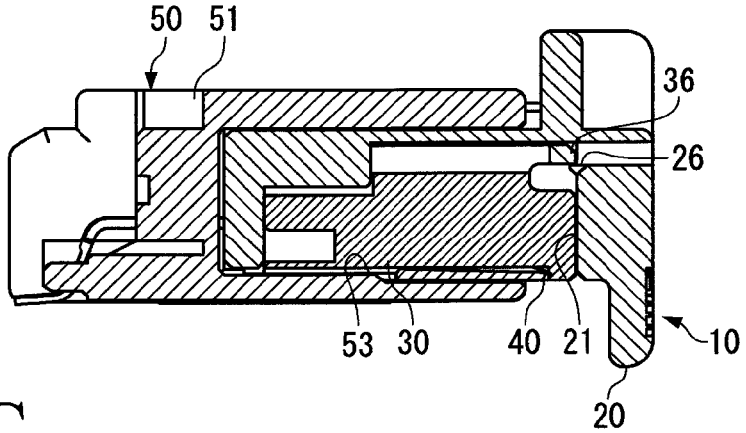
FIG. 6B is a cross-sectional view the engagement mechanism of the lance housing and the connector housing according to the invention showing the locking protrusion provided at a rear part of the lance housing.
Figure 6C:
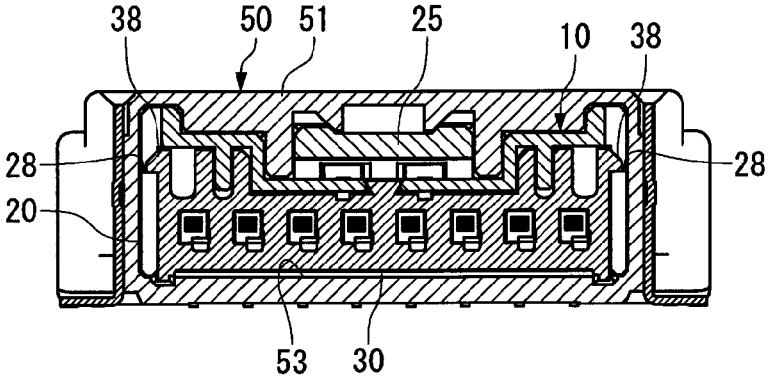
FIG. 6C is a cross-sectional view an engagement mechanism of the lance housing and the connector housing according to the invention showing a plurality of locking protrusions provided on the opposite sides of the lance housing.

As shown in FIGS. 5A and 5B, the fitting recess 53 has a stepped support 55 that houses the retainer 40 protruding from the top surface 30*c* of the lance housing 30 when the female connector 10 is inserted into the fitting recess 53 and the engaging protrusion 25*b* of the locking member 25 is engaged with the latch 54.

As shown in FIG. 5B, as the female connector 10 is inserted into the fitting recess 53 of the male connector 50, the guide walls 39 and 39 formed on the lance housing 30 on the opposite sides of the retainer 40 comes into contact with an end part 55*a* of the stepped support 55.

Since the height of the guide walls 39 and 39 in the direction perpendicular to the top surface 30*c* gradually increases from the front surface 30*a* toward the rear surface 30*b* of the lance housing 30, when the female connector 10 is further inserted into the fitting recess 53 of the male connector 50, the guide walls 39 and 39 and the end part 55*a* of the stepped support 55 rub against each other as the female connector 10 is inserted.

When the female connector 10 is completely inserted into the fitting recess 53 of the male connector 50, and the engaging protrusion 25*b* is engaged with the latch 54, the female terminals held in the lance housing 30 and the male terminals 52 held in the housing 51 of the male connector 50 are electrically connected to each other.

As described above, since the lance housing 30 has the guide walls 39 and 39 disposed in the vicinity of the tip end part 40*a* of the retainer 40, the female connector 10 can be smoothly inserted and fitted into the fitting recess 53 of the male connector 50.

In addition, the guide walls 39 and 39 can prevent the retainer 40 interposed therebetween from interfering with the housing 51 of the male connector 50. As a result, the retainer 40 can be prevented from being fractured, and the durability and the reliability can be improved.

Although the guide walls 39 and 39 are formed on the lance housing 30 in the embodiment described above, the guide walls 39 and 39 may be formed on the connector housing 20. In that case, the same advantages as those described above can be achieved.

The components described in the above embodiment can be appropriately omitted or modified without departing from the spirit of the present invention.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A connector member for connection with a mating connector comprising:

a lance housing having a plurality of terminal receiving slots, a recess opened from a planar top surface and formed in a portion near a rear surface of the lance housing, and a pair of guide walls positioned opposite to each other along and projecting from the planar top surface;

a connector housing having a housing recess opening at one side for housing the lance housing;

a retainer having a plate part with a hinge disposed at a side closer to the rear surface and a tip end part disposed at another side closer to a front surface, and being fitted into the recess and swingably connected to the lance housing the hinge; and wherein a height of each of the pair of guide walls extends in a direction perpendicular to the top planar surface and gradually increases from the front surface to the rear surface of the lance housing; and wherein the height of the each of the pair of guide walls is equal to or greater than the tip end part of the retainer.

2. The connector member according to claim 1, wherein the connector housing further includes a plurality of engaging recesses to be engaged with the lance housing.

3. The connector member according to claim 2, wherein the plurality of engaging recesses are disposed in the housing recess.

4. The connector member according to claim 1, wherein the connector housing further includes a locking member to be engaged with the mating connector.

5. The connector member according to claim 4, wherein the locking member includes a cantilever beam fixed at one end facing to the mating connector and is free at an opposite end.

6. The connector member according to claim 5, wherein the locking member further includes an engaging protrusion disposed on a surface of the cantilever beam.

7. The connector member according to claim 6, wherein the locking member further includes an operating part disposed at the opposite end of the cantilever beam.

8. The connector member according to claim 1, wherein the lance housing includes a plurality of locking protrusions.

9. The connector member according to claim 8, wherein the connector housing includes engaging recesses are disposed in the housing recess of the connector housing.

10. The connector member according to claim 9, wherein the plurality of locking protrusions are engaged with the engaging recesses when the lance housing is inserted into the housing recess of the connector housing from a bottom surface thereof.

* * * * *